US005725061A

United States Patent [19]

Van Steenwyk et al.

[11] Patent Number: 5,725,061

[45] Date of Patent: Mar. 10, 1998

[54] DOWNHOLE DRILL BIT DRIVE MOTOR ASSEMBLY WITH AN INTEGRAL BILATERAL SIGNAL AND POWER CONDUCTION PATH

[75] Inventors: Donald H. Van Steenwyk, San Marino; Michael S. Orcutt-Clenard, Atascadero, both of Calif.; James Robbie Higginbotham, Lafayette, La.

[73] Assignee: Applied Technologies Associates, Inc., Paso Robles, Calif.

[21] Appl. No.: 653,636

[22] Filed: May 24, 1996

[51] Int. Cl.[6] ..... E21B 4/04; E21B 47/01

[52] U.S. Cl. ..... 175/104; 175/40; 175/320

[58] Field of Search ..... 175/92, 104, 107, 175/40, 320; 166/385

[56] References Cited

U.S. PATENT DOCUMENTS

| | | | |
|---|---|---|---|
| 3,866,678 | 2/1975 | Jeter | 175/104 X |
| 3,879,097 | 4/1975 | Oertle | 340/855.1 |
| 3,918,537 | 11/1975 | Heilhecker | 175/320 |
| 4,051,456 | 9/1977 | Heilhecker et al. | 175/104 X |
| 4,143,722 | 3/1979 | Driver | 175/320 X |
| 4,215,426 | 7/1980 | Klatt | 367/83 |
| 5,160,925 | 11/1992 | Dailey et al. | 340/853.3 |
| 5,269,383 | 12/1993 | Forrest | 175/107 X |
| 5,456,106 | 10/1995 | Harvey et al. | 73/152.46 |

*Primary Examiner*—David J. Bagnell

*Attorney, Agent, or Firm*—Christie, Parker & Hale, LLP

[57] ABSTRACT

A downhole drill bit drive motor assembly which provides a bilateral low resistance path from the upper end of a downhole drill bit drive motor to the lower end of such a motor by employing an insulated wire or group of several wires through the rotor of the motor. The drive motors provide a drive torque to a drill bit based on the flow of drilling fluids through the motor and includes an outer case, a motor stator, a motor rotor, a coupling to connect the motor rotor to an output shaft and a bearing to support both axial and radial loads. Fixed electrical contacts are provided at the upper end of the drill bit drive motor to provide connection to wireline for transmission of data from that point to the surface or other higher points. Rotary electrical contacts that provide continuous electrical contact as a rotary portion rotates with respect to a stationary portion are provided at the upper, lower, or both ends of the rotor. An electrical conductor is extended through the interior of the motor rotor, coupling and output shaft to the bit box on the end of the shaft that accommodates the drill bit.

20 Claims, 12 Drawing Sheets

DOWNHOLE DRILL BIT DRIVE MOTOR ASSEMBLY WITH AN INTEGRAL BILATERAL SIGNAL AND POWER CONDUCTION PATH

BACKGROUND OF THE INVENTION

1. Field of the Invention

The present invention relates generally to the field of measure-while-drilling (MWD) applications for oil and gas well drilling operations. More particularly, this present invention relates to a downhole drive motor assembly for a drill bit which incorporates within the motor a bilateral signal and power conduction path which allows placement of the instrument package directly adjacent the drill bit for maximum accuracy of readings.

2. Prior Art

Present practice in measure-while-drilling operations for the drilling of boreholes in the earth often includes use of a downhole motor driven by the drilling fluid or other means. When such a motor is used, it has been necessary to locate the sensors and/or transmitters of bottom hole data remote from the drill bit and behind or above the motor. Thus the sensed data is not directly indicative of the conditions at the drill bit. It is believed that advantages in drilling efficiency and safety could be obtained if the sensors and/or transmitters could be located directly behind the drill bit. Sensors applicable to this approach include sensors for azimuth, inclination, high side, weight-on-bit, torque-on-bit, pressure, temperature, porosity, seismic, ultrasonic, electromagnetic, resistivity, electric field, magnetic field, atomic, gamma ray or any other parameter of use in the drilling and reservoir analysis arts.

It therefore would be highly desirable to have a telemetry system that would permit transmission of sensor data from a drill bit location past the motor or other mechanically complex elements directly to the surface or to a secondary location above the motor. In the latter case the data could then be processed and/or re-transmitted to a surface location by any of several well known means. Further, it is also highly desirable to have a means to transmit electrical power past the motor or other mechanically complex element so as to minimize the number of power sources required in the bottom hole assembly.

An example of a short range telemetry means is addressed by U.S. Pat. No. 5,160,925. In this patent, a short range telemetry link is provided by a co-axial toroid around the lower end of the motor adjacent to the drill bit and another such toroid around the upper end of the motor a significant distance from the drill bit. Communication is established between these two toroids by the method of inducing electrical current flow in the structure of the bottom hole assembly. Such induced current created by the first lower toroid flows through the second upper toroid remote from the drill bit and then returns through the earth to the structure below the first toroid, a generally high resistance path. This high resistance return path severely attenuates the signal strength of the data being transmitted. Further, the high resistance precludes the transmission of significant power from one end of the motor to the other so that battery or other power generation means are required at both ends of the motor. The problem of signal attenuation in U.S. Pat. No. 5,160,925 is partially addressed by the transmission of various test signal frequencies from one end of the motor to the other end of the motor using the two toroids and a choice of operation frequency for data transmittal is made based on the test results.

U.S. Pat. No. 5,160,925 states that hard-wire connectors have been proposed to provide a hard wire connection from a bit to the surface. U.S. Pat. Nos. 3,879,097, 3,918,537 and 4,215,426 are cited as examples of such hard-wire systems. Review of these patents shows that they relate to various means of connecting or operating wirelines in drill strings. However, none of them show any sort of motor or other complex structure between the drill bit and the surface. Thus they do not address in any manner the subject of this invention to provide a wire means through such a motor or other complex structure.

Another example of prior art is U.S. Pat. No. 5,456,106 which describes a modular sensor assembly located within the outer case of a downhole mud motor between the stator assembly of such a motor and the lower end of the outer case where radial and thrust bearings are located. This sensor assembly is connected to a region above the motor stator by a wire mounted in the outer case. Thus it does not permit connection to sensors located immediately adjacent the drill bit.

It would therefore be desireable for an MWD system to employ a drilling motor system which overcomes the shortcomings of the prior art by:

1) Providing a bilateral path between a point above a downhole drill bit drive motor and a point below such a motor adjacent to the drill bit, 2) Assuring that the path is of very low resistance, 3) Making the path suitable for bilateral transmission of electrical signals, electrical power, or both.

It is additionally desireable that such a drill motor system use the benefits previously described to permit the location and operation of directional and logging sensors and transmitters directly adjacent to the drill bit to improve the accuracy and efficiency of the drilling process. The direct low resistance transmission path permits providing electrical power from a location above the drill motor and low attenuation signal transmission from the sensors to a point above the motor.

SUMMARY OF THE INVENTION

The invention provides a bilateral low resistance path from the upper end of a downhole drill bit drive motor to the lower end of such a motor by employing an insulated wire or group of several wires through the rotor of the motor. The drive motors contemplated by the invention include any known configuration that provides a drive torque to a drill bit based on the flow of drilling fluids through the motor. The invention constitutes an alteration or improvement in such known motor design. Such motors generally include an outer case, a motor stator, a motor rotor, a coupling means to connect the motor rotor to an output shaft and a bearing means to support both axial and radial loads.

The improvements of this invention include the following items. Fixed electrical contact means are provided at the upper end of the drill bit drive motor to provide connection to wireline or other means for transmission of data from that point to the surface or other higher points. Rotary electrical contact means that provide continuous electrical contact as a rotary portion rotates with respect to a stationary portion are provided at the upper, lower, or both ends of the rotor in alternative embodiments specific to each application. An electrical conductor, such as a section of conventional wireline having one or more inner copper electrically conducting wires surrounded by a twisted or braided steel covering, is extended through the interior of the motor rotor, coupling and output shaft to the bit box on the end of the shaft that accommodates the drill bit.

A variety of sensors and transmitters for directional or logging purposes can be included adjacent the drill bit and connected electrically to a point above the drive motor by the wires through the interior of the motor. Sensors and transmitters for use with the structure of the present invention include accelerometers, magnetometers, gyroscopes, formation resistivity sensors, gamma ray sensors or any of the other well known logging sensors. The location of these sensors and transmitters immediately above the drill bit provides improved accuracy and relevance of sensed data to the immediate drilling process. Since the electrical connection through the interior of the drive motor is of low resistance, these sensors are provided electrical power from a source above the drive motor. This eliminates any need for batteries or other power generation apparatus below the drive motor.

In one embodiment of the invention a tensioning means is included to maintain a portion of the internal wireline between the rotary electrical connection and the upper end of the motor rotor in tension during operation.

DETAILED DESCRIPTION OF THE INVENTION

Figure 1:
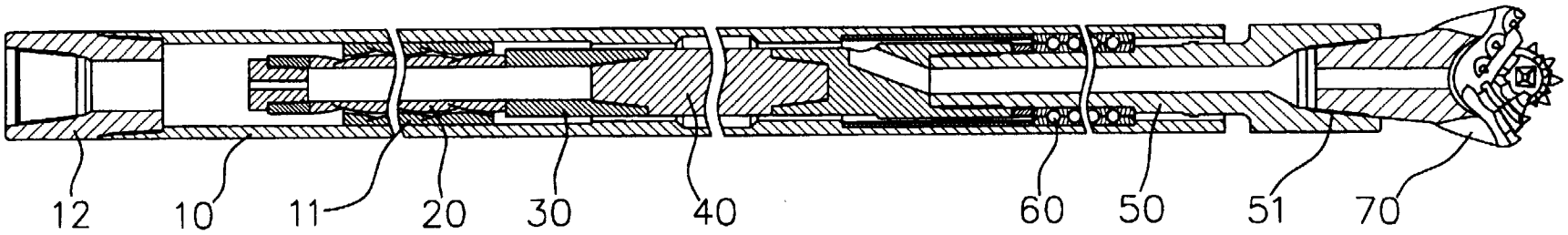
FIG. 1 PRIOR ART
FIG. 1 is a generalized mechanical schematic of a prior art downhole drill bit drive motor in side cross section showing the principal features.

FIG. 1 shows a generalized schematic of a downhole bit drive motor of current technology that is well known. Such a motor is located at the bottom end of a drill string. The motor has an outer case 10 which is screwed onto a drill string by the threaded connection 12. Within the outer case is a motor stator 11 which may have many forms. The form shown is of the well-known Moineau type. Within the region of the motor stator, a motor rotor 20 is driven by the flow of drilling mud in the annular space between the motor rotor and motor stator. The flow of drilling mud causes a torque tending to rotate the motor rotor and apparatus connected to the motor rotor. The motor rotor shown is also of the Moineau type. The lower end of the motor rotor is connected to a mechanical shafting assembly which comprises a motor output shaft 30, a coupling 40 and an output mandrel and bit box 50. The motor output shaft provides mechanical connection from the motor rotor to the coupling. The length of the motor output shaft depends on the type of coupling to be used and other design choices. The coupling may be of a variety of types, depending on the motions required to accommodate the motions of the rotor to the output mandrel & bit box. For example, if the motor was of a standard turbine type only a simple solid coupling would suffice. However, if the motor was of the well known Moineau type the coupling would have to accommodate eccentric or angular motions of the lower end of the rotor to the angularly-fixed mandrel. Some sort of universal joint of any known sort might be used for such a coupling. In some designs a simple section of flexible shaft can provide the coupling function. A bearing assembly 60 provides radial and axial support to the output mandrel and bit box. A threaded connection 51 provides a means to connect the drill bit 70 to the output mandrel & bit box.

Figure 2:
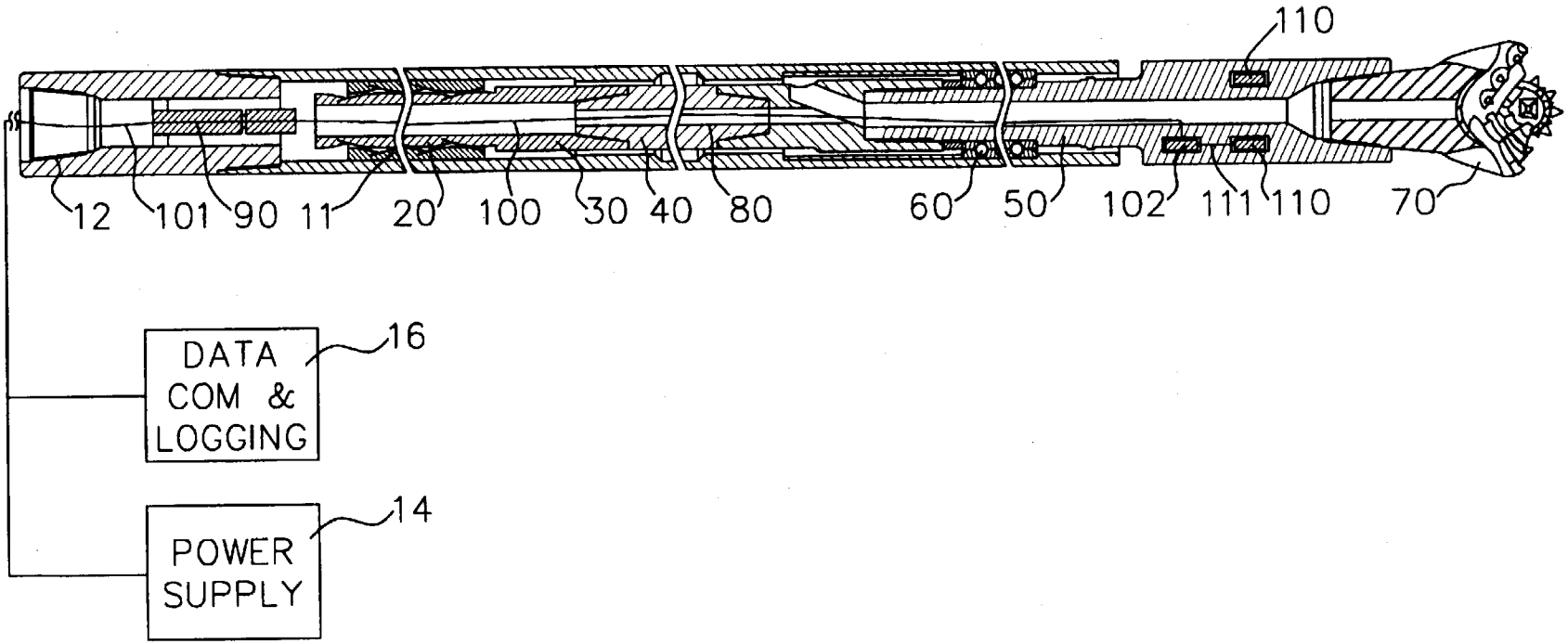
FIG. 2 is a side cross section view of a generalized embodiment of the present invention that provides an integral bilateral signal and power conductive path through such a motor.

FIG. 2 shows the configuration of a motor employing the present invention which uses the common numbering of elements defined for FIG. 1. First, an external wire 101 is connected to the apparatus above the motor using a rotary electrical connector 90. A power supply 14 and data communications and control system 16 are located uphole from the drill motor outer case, either at the surface or in a properly equipped sub located in the drill string. This rotary electrical connector, in the embodiments shown in the drawings, is a direct rotating contact type known in the art. Those skilled in the art will recognize alternative connectors for use in particular applications of the present invention including a rotary transformer. In the first case of direct rotating contact type, power and signal data is transmitted in either a direct current form or in an alternating current form. In the case of a rotary transformer, power and signal data must be transmitted in an alternating current form. The upper end of the rotary electrical connection is mounted to the motor outer case and does not rotate. The lower end rotates and is connected to an electrical connecting wire 100 that extends through a central bore in the drill motor rotor, a clear opening or bore in the coupling, and a central bore in the drill mandrel and bit box, all generally designated 80, to a bit box terminal block 102. From this terminal block, various connections 111 can be made to an array of sensors, transmitters and processors 110 mounted in or on the bit box adjacent to the drill bit. Such sensors may include any of the well known directional or logging sensors.

Figure 3A:
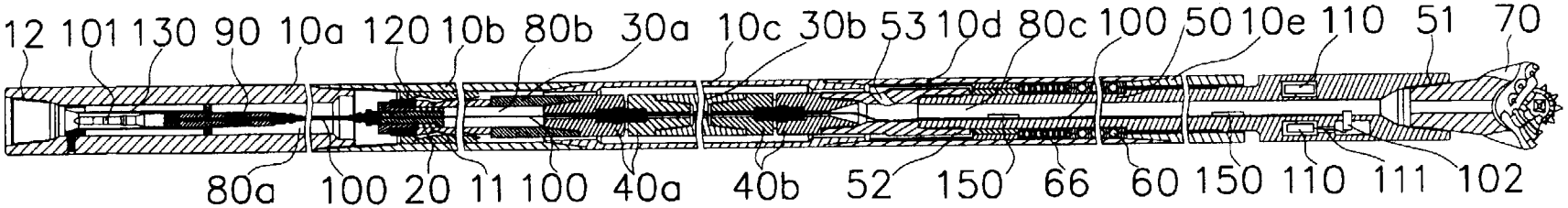
FIG. 3A is a detailed cross section view of one embodiment of the invention.

FIG. 3A shows a detailed cross section of one embodiment of the overall motor. The outer case is shown divided into five sections, **10*a*–10*e*, to facilitate assembly of the complete motor. The threaded connection 12 permits connection of the motor to the drill string above the motor. The drill string electrical wire connection 101 is of the wet connect type described in U.S. Pat. No. 5,389,003 and provides a separable electrical connection means to points above the motor. The electrical wire connection is supported to the motor outer case by an electrical wire connection mounting fixture 130. The rotary electrical connection 90** accommodates the rotation of the electrical conducting wire 100 with respect to the stationary drill string electrical wire connection, as will be described in greater detail subsequently. A clear space 80a extends through the drill motor case section 10a between the rotary connection and the motor rotor 20 contained in the second section of the motor case 10b. A wire tensioning assembly 120 is provided to maintain the section of the electrical conducting wire between the rotary electrical connection and the upper end of the motor rotor in tension. Maintaining the electrical conducting wire in tension provides accommodation to overall path length changes due to temperature, wear or loading effects.

The motor output shaft 30 is shown in two sections, a first section 30a extending from the motor rotor to the first coupling 40a and the second section 30b extending between the first coupling and second coupling 40b. The couplings are of a post and pivot type described in greater detail in FIGS. 6A through 6D. Two successive couplings of this type are required in the embodiment shown in the drawings, to accommodate the eccentric and angular motion of the lower end of the Moineau-type motor rotor. A mandrel connection shaft 52 connects the second coupling to the mandrel and bit box. Ports 53 from the exterior to the interior bore 80c of the mandrel connection shaft permit drilling fluid that has passed around the electrical wire connection, through the gap between the motor rotor and the motor stator 11 and through the gap between the motor output shaft/couplings and the outer case to return to the interior of the mandrel and bit box and continue on to the drill bit 70. A bearing assembly 60 for radial and axial support of the output mandrel and bit box comprises a stack of conventional ball bearings, journal bearings or PDC bearings. The electrical conducting wire continues on through the clear path inside the mandrel and bit box to a bit box terminal block 102. The wire in this region is attached to the side wall of the mandrel interior bore by clips 150 and are attached in alternate embodiments by any suitable means.

Alternatively, in some embodiments the wire extends through the center of the clear space and includes another wire tensioning assembly similar to that shown inside the motor rotor at its upper end. Logging and drilling parameters such as weight or torque on bit and/or directional sensors 110 are provided in the bit box as required for any particular drilling scenario. These sensors are connected to the bit box terminal block by an electrical wire connection 111. Since electrical power for these sensors can be provided by means of the electrically conducting wire through the motor, no battery or other power source is required within the bit box region. This allows more volumetric space for useful sensors.

Figure 3B:
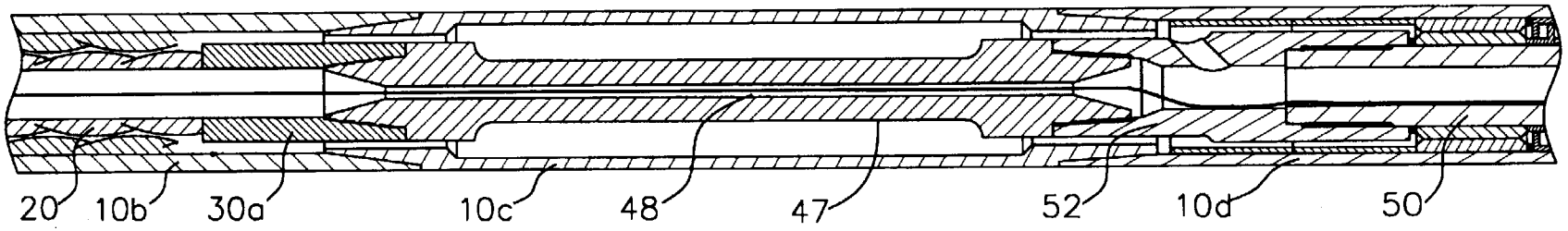
FIG. 3B is a detailed cross section view of a portion of a second embodiment of the invention employing a reduced cross section torsion bar as an alternative connection.

FIG. 3b shows an alternative connector arrangement for the present invention employing a torsion bar 47 for interconnection of the motor output shaft from the rotor to the mandrel connection shaft. The torsion bar incorporates a reduced cross section to provide the necessary lateral flexibility yet retains longitudinal and torsional rigidity required for transmission of rotary power to the mandrel and subsequently the drill bit. A central bore 48 in the torsion bar provides a clear space to accommodate the conductor wire.

Figure 3C:
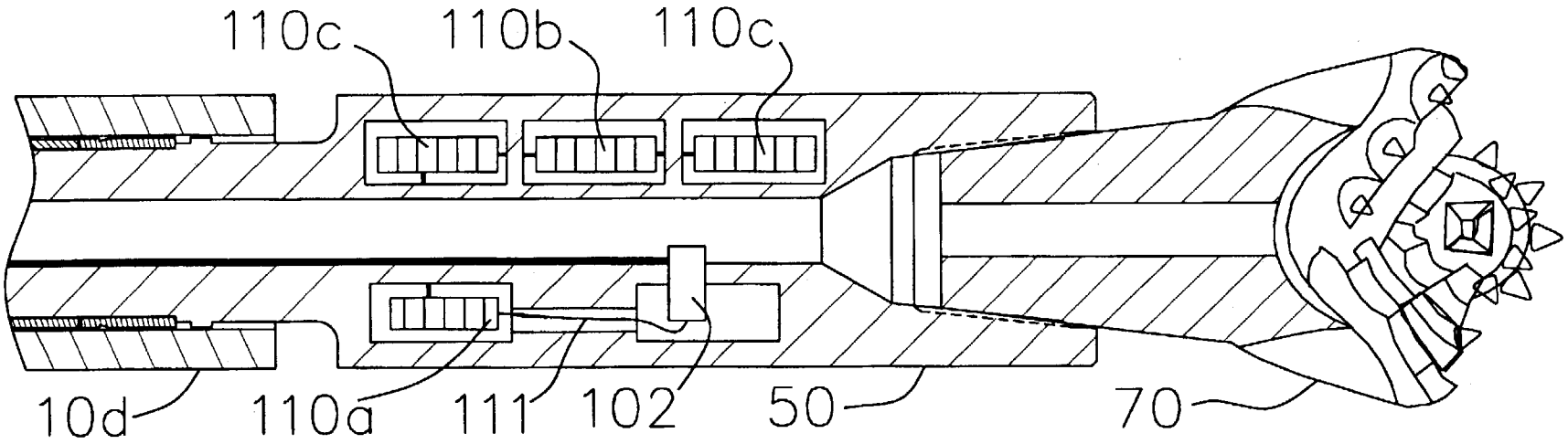
FIG. 3C is a detailed cross section view of the drill head portion of the tool demonstrating an exemplary sensor package arrangement.

FIG. 3c demonstrates schematically an exemplary electronics and sensor package for the invention. An electronics control package generally designated 110a is incorporated in a first chamber in the drill mandrel and includes a microprocessor for sensor system and data control, dedicated sensor control processors, signal conditioner and transmitter for connection to the conductor wire through connector 102. Transmitters and sources generally designated 110b for active sensors are mounted in a second chamber in the mandrel and include electro-magnetic and magnetic field generators, ultrasonic transmitters and neutron and pulsed neutron sources. Active and passive sensors, generally designated 110c, are located in additional chambers in the mandrel and include azimuth, inclination, high side, weight on bit, torque on bit, annulus and bore hole pressure, temperature, porosity, seismic, ultrasonic, electromagnetic, resistivity, electric field, magnetic field, atomic and gamma ray sensors.

Figure 4A:
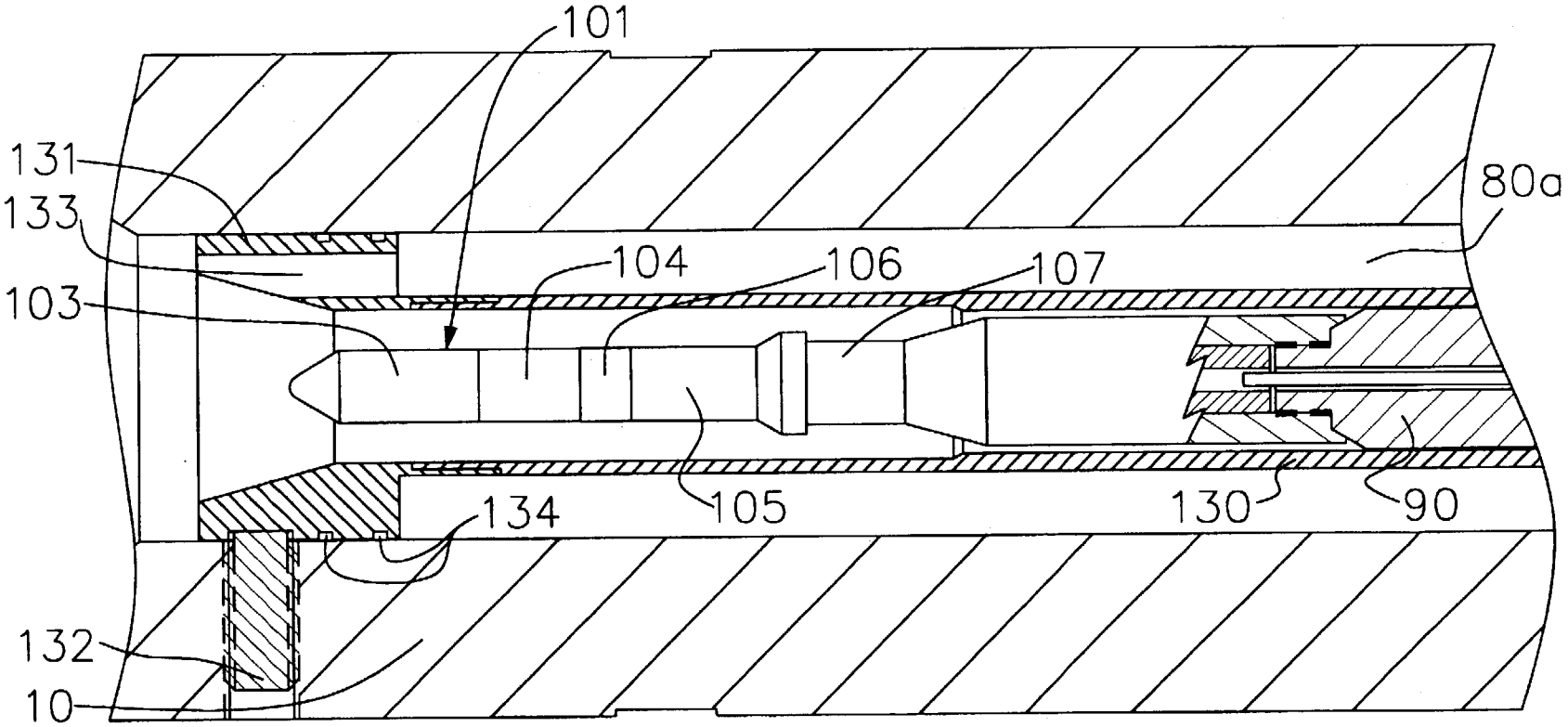
FIG. 4A is a cross section view showing details of the connector at the upper end of the motor.

FIG. 4A shows an expanded view of the motor-fixed half of the drill string electrical wire connection 101. The electrical wire connection comprises a metal structural tip 103, an electrical insulator 104, another electrical insulator 105, a metal electrical contact 106 and a support structure 107. The details of such a connection are shown in U.S. Pat. No. 5,389,003 which also shows a mating connector that engages with this connection half to complete electrical connection to apparatus above the drill bit drive motor. The electrical connection assembly is supported by an electrical wire connection mounting fixture 130 and its bypass ring 131. This bypass ring is locked to the motor outer case by the screw securing element 132. A series of openings 133 in the bypass ring permit the flow of drilling fluids to bypass the connection assembly and flow through the bore 80a of the first section of the motor case to the gap between the motor stator and rotor. Although the design show in FIG. 4A is for a single electrical connection, multi-conductor connections of similar design are used in alternative embodiments.

Figure 4B:
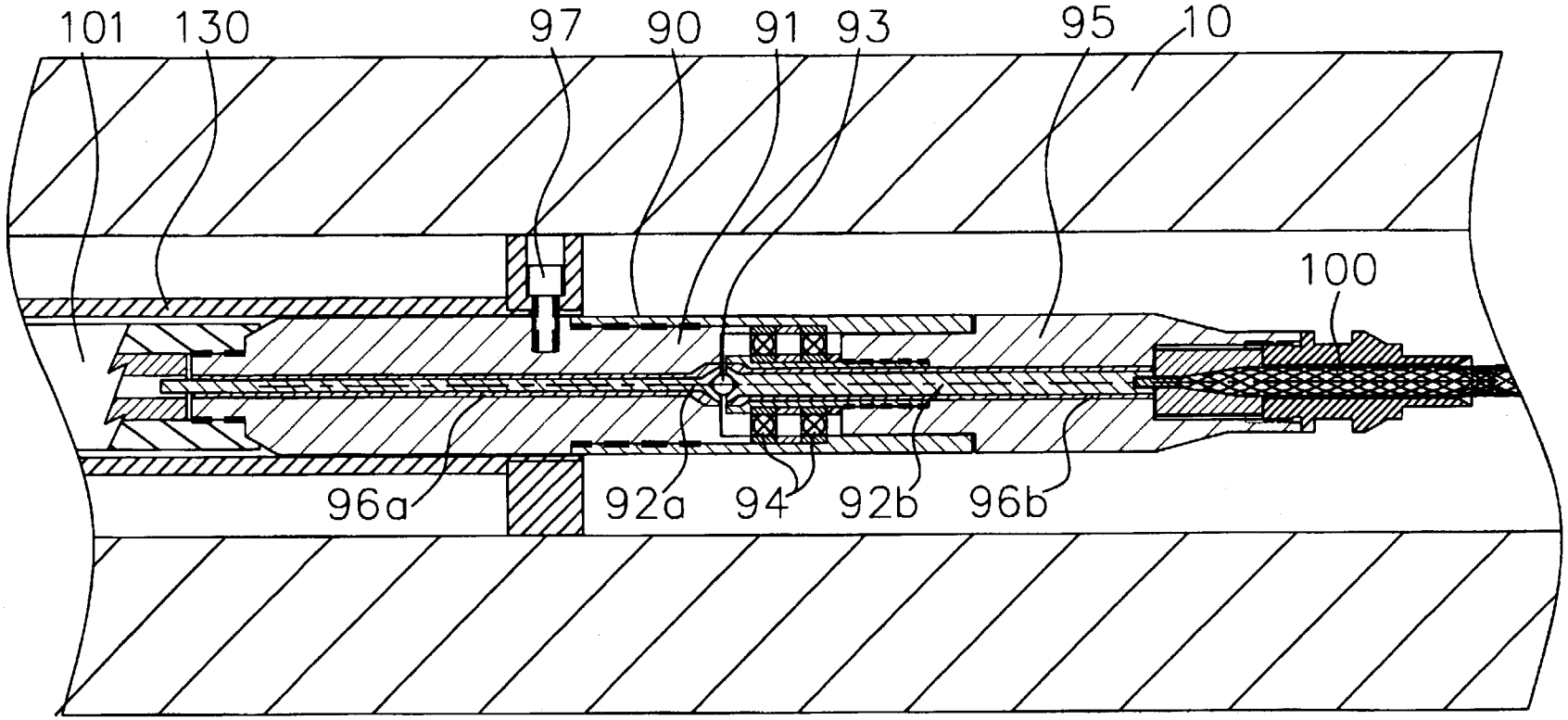
FIG. 4B is a cross section view showing details of the rotary electrical connector.

FIG. 4B shows an expanded view of the rotary electrical connection 90 that accommodates the transition of the electrical conducting path from the stationary portion to the portion that rotates with the motor rotor and its attached output elements. An electrical conductor 92a, insulated by input insulator 96a is connected to the metal conducting tip of the drill string electrical wire connector and provides the fixed inner conductor for the rotary electrical connection. An electrical conductor 92b, insulated by output insulator 96b, provides the rotary output conductor. An electrically conducting ball 93 accommodates the rotary angular motion between the input and output conductors and provides an electrical connection between them. A rotating support 95 that carries the output conductor and its insulation is supported axially and for rotation by the twin ball bearings 94. Thus, the rotating support is held axially to but is rotationally free from non-rotation support 91. The non-rotating support is fixed to the electrical wire connection mounting fixture 130 by screw 97.

Figure 4C:
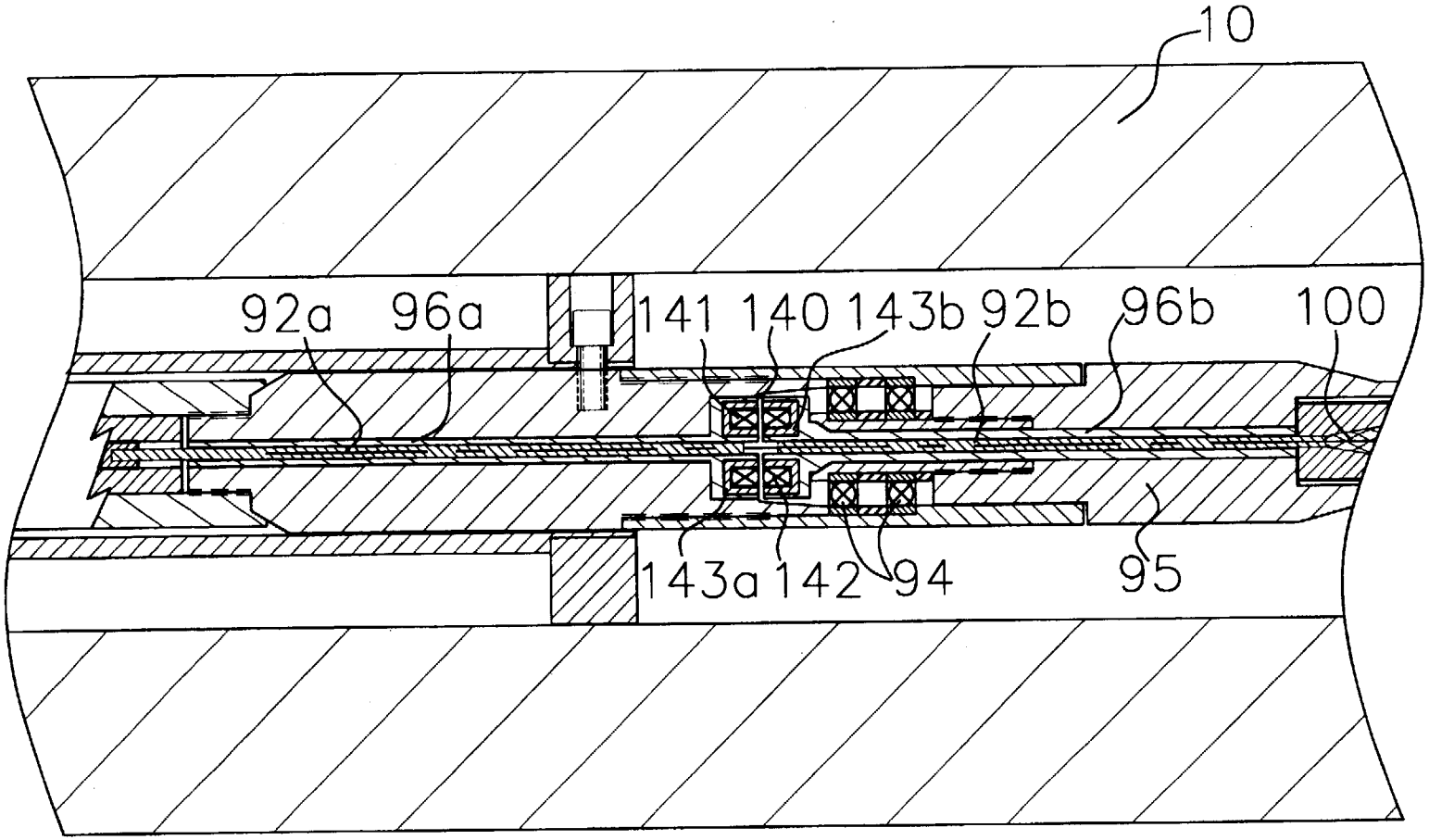
FIG. 4C is a cross section view showing details of an alternative rotary transformer connector.

An alternative rotary transformer type connector is shown in FIG. 4C. The electrically conducting ball interconnecting conductors 92a and 92b is replaced by a rotary transformer 140 for transmission of AC signals. The rotary transformer employs a first winding 141 electrically connected to conductor 92a and a second winding 142 electrically connected to conductor 92b. Magnetic coupling between the first and the second winding is enhanced by non-rotating magnetic core 143a and rotating magnetic core 143b.

Figure 5:
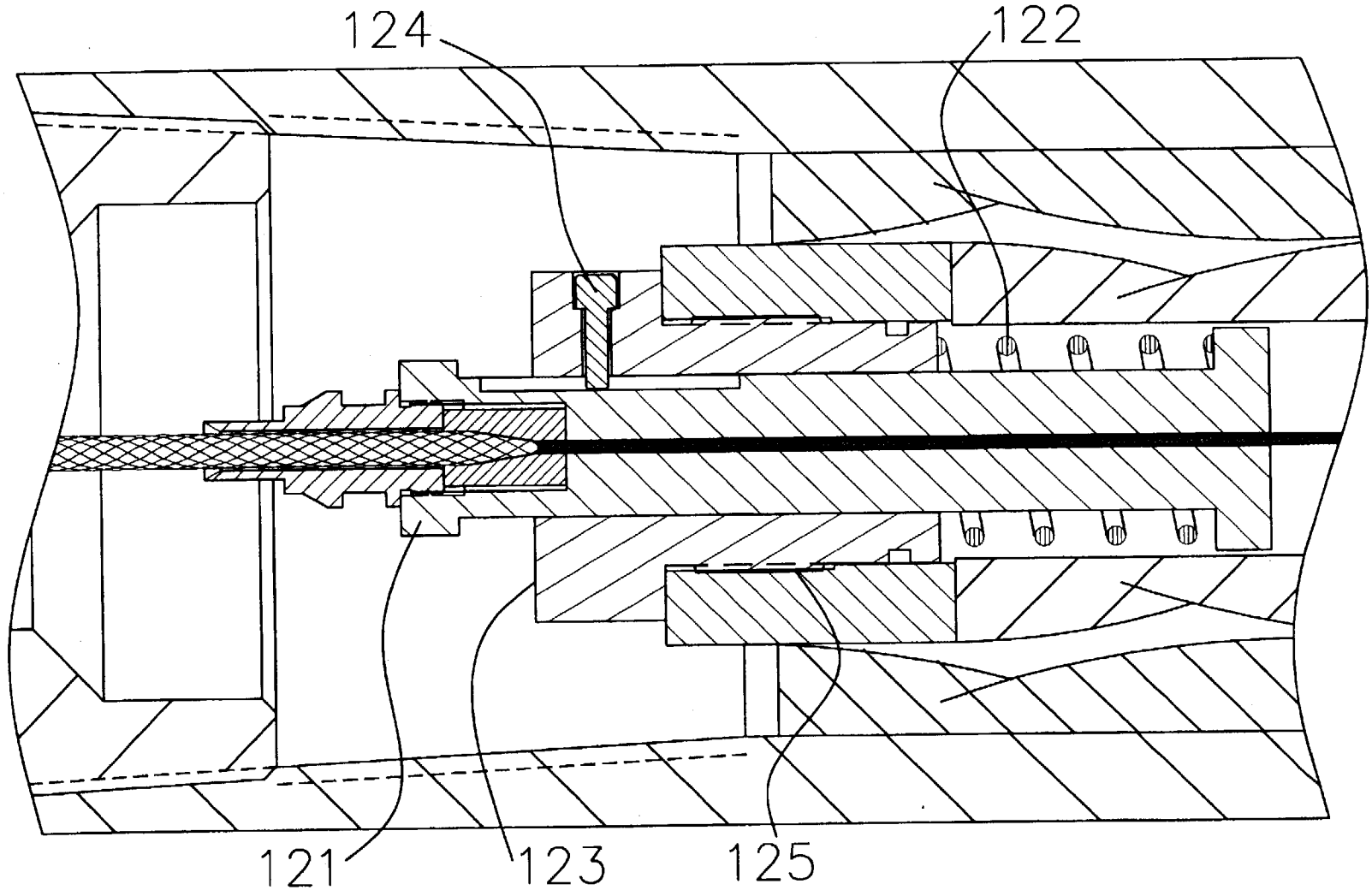
FIG. 5 is a detailed cross section of a tensioning assembly for the electrical conductor section within the motor rotor.
Figure 6A:
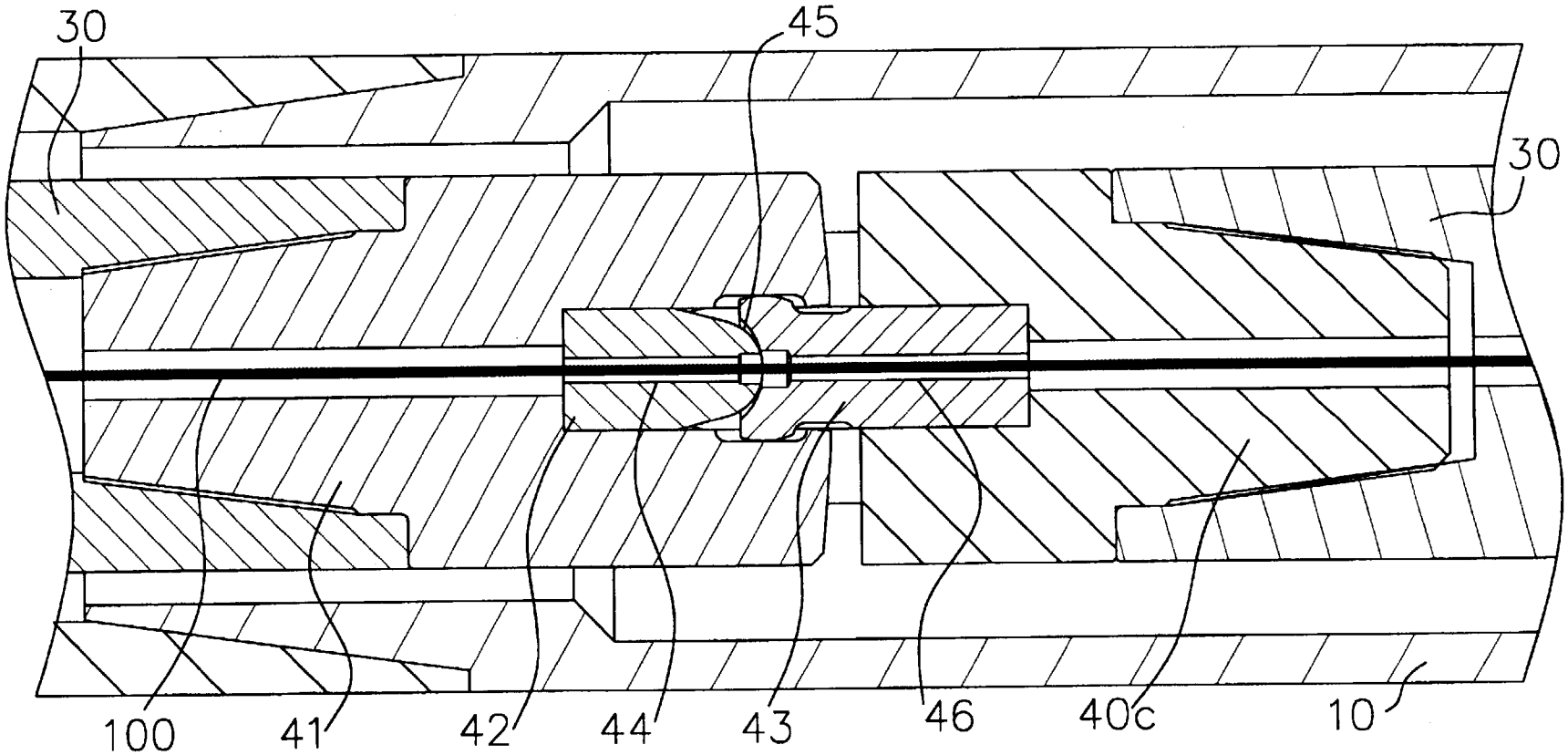
FIG. 6A is a detailed cross section of one design for a coupling.
Figure 6B:
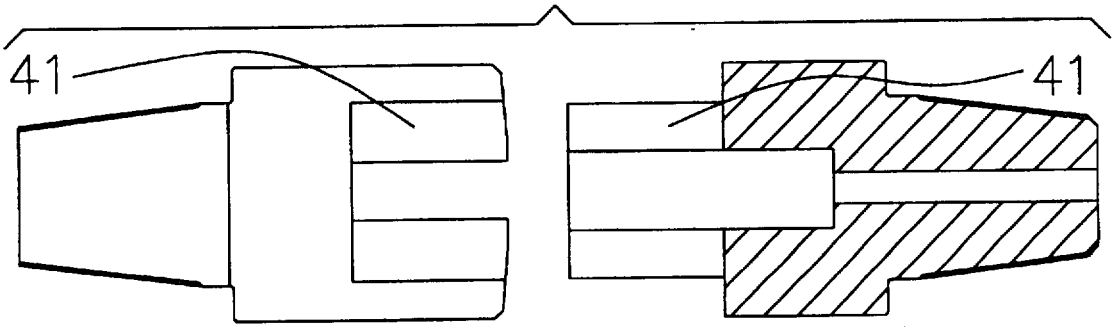
FIG. 6B is an exploded side view of the coupling of FIG. 6A.
Figure 6C:
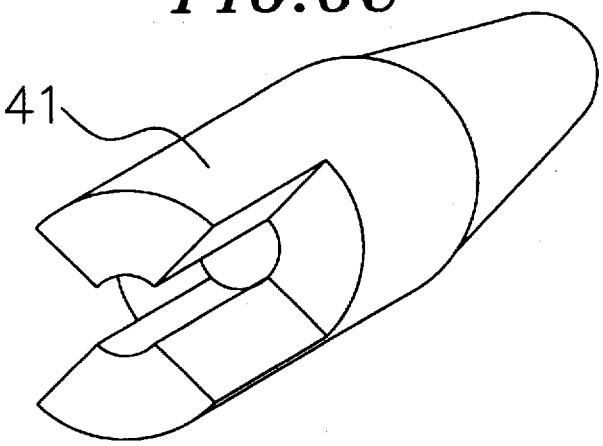
FIG. 6C is an isometric view of one-half of the coupling of FIG. 6A.
Figure 6D:
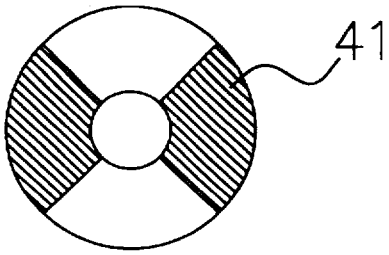
FIG. 6D is an end view of the coupling half shown in FIG. 6C.

FIG. 5 shows the wireline tensioning assembly. The electrical wire from the rotary electrical coupling is attached to a sliding plunger 121 which is forced away from a guide 123 by a spring force element 122. The sliding plunger is held in angular relation to the guide by an anti-rotation key 124. The guide is attached to the motor rotor by a threaded engagement 125. These elements acting together maintain tension in the section of electrical conductor between the rotary electrical contact and the upper end of the motor rotor. The tensional force can be adjusted by selection of the spring force constant of the spring and the initial compression length.

FIGS. 6A through 6D show details of couplings 40*a* and 40*b* that connect motor output shaft 30 to the mandrel and bit box 50. Each of the two couplings is a commonly used post and pivot universal joint 40*c* which allows torque produced by the motor rotor to be transferred axially through it but provides freedom for limited angular or eccentric motion of one end in relation to the other end. For each coupling there is a set of forked elements 41 which, when axially engaged, transmit torque from one part to the other. The intermeshed forks transmit torque through the joint by intimate angular contact of their coacting faces. Assembled in the center of each pair of forked elements are a post 42 with a ball shaped end which faces a pivot 43 with a cup shaped end. These meet and contact along a generally spherical surface 45 which carries the thrust load across the coupling but generally provides limited angular freedom. A center borehole 44 through the post and a center borehole 46 through the pivot provide the clear space needed for the electrical conductor.

Figure 7:
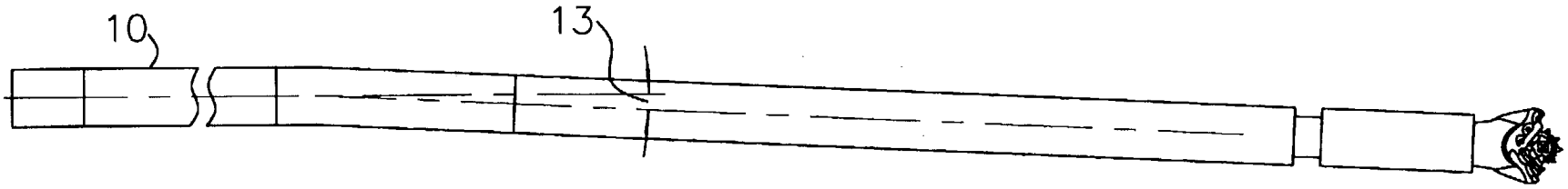
FIG. 7 shows an external view of a downhole drill bit motor having an angular bend in its outer case.

For some drilling situations, it is desirable to have a small bend angle in a downhole drill bit drive motor. FIG. 7 shows such a motor outer housing having a bend angle 13. The internal elements of such a motor having a bend angle are basically identical to those previously described for a motor without a bend angle. In one embodiment, the bend angle is placed at the axial center of the coupling element. This permits the coupling elements previously described to accommodate angular motions to serve the same function for the bent motor. If it is desired to place the bend angle at another axial location, additional angular couplings are included within the drive motor at the axial location of the desired bend angle. Useful bend angles for such motors lie in the range of one quarter to five degrees.

Having now described the invention in detail, as required by the patent statutes, those skilled in the art will recognize modifications, substitutions and alterations to the embodiments shown in the drawings and described herein for particular applications of the invention. Such modifications, substitutions and alterations are within the scope and intent of the present invention as defined in the following claims.

What is claimed is:

1. A downhole drill bit drive motor for use in drilling boreholes in the earth comprising:

a) an outer case;

b) a drive motor supported within said outer case;

c) a mechanical shafting means to provide a driving torque to an attached drill bit;

d) a coupling means connected to said mechanical shafting means to provide mechanical connection to and to accommodate eccentric or angular motions of said drive motor;

e) a bearing assembly to provide radial and axial support for said mechanical shafting means; and f) a bilateral electrical conductor extending axially through said motor, said coupling means and said mechanical shafting means to a connection proximate said drill bit, said electrical conductor including (1) at least one electrically conducting wire, (2) at least one rotary electrical connection means providing rotational capability for said at least one conducting wire.

2. An apparatus as defined in claim 1 wherein said drive motor comprises a rotor and stator which comprises:

a) said stator supported by said outer case, and b) a spiral type rotor assembly received within said stator and connected to said coupling means for developing a torque on said shafting means in response to flow of drilling fluid between said stator and said rotor, said at least one electrically conducting wire extending through said rotor.

3. An apparatus as defined in claim 2 further comprising a wire-tensioning means to tension said at least one electrically conducting wire between said rotary electrical connection means and said motor rotor assembly.

4. An apparatus as defined in claim 1 including a set of sensors of drilling-related parameters mounted on said mechanical shafting means proximate said drill bit and means for electrically connecting said sensors to said at least one electrically conducting wire.

5. An apparatus as defined in claim 4 wherein said drilling-related sensors include means to determine the inclination of said drill bit.

6. An apparatus as defined in claim 4 wherein said drilling-related sensors include means to determine the azimuthal direction of said drill bit.

7. An apparatus as defined in claim 4 wherein said drilling-related sensors include means to measure weight on said drill bit.

8. An apparatus as defined in claim 4 wherein said drilling-related sensors include means to measure torque acting on said drill bit.

9. An apparatus as defined in claim 4 wherein said drilling-related sensors comprise logging sensors to measure formation parameters of the area being drilled including resistivity, porosity, density, permeability and interfaces between various borehole fluids.

10. An apparatus as defined in claim 4 further comprising an electrical power supply located remotely uphole from said outer case and a borehole communication means located remotely uphole from said outer case and wherein said bilateral electrical conductor is connected to said power supply and said communication means, and transmits electrical power from said power supply to said connection proximate said drill bit and transmits signals from said sensors to said communication means.

11. An apparatus as defined in claim 4 wherein said sensors include processing electronics.

12. An apparatus as defined in claim 4 wherein a transmitter means is provided to transmit the output of said sensors to the surface or other location above said motor.

13. An apparatus as defined in claim 4 wherein said sensors includes receiving apparatus to receive control or operation data from a location above said motor.

14. An apparatus as defined in claims 1 wherein said outer case has a bend angle, generally in the range of one-quarter to five degrees.

15. An apparatus as defined in claim 11 wherein the coupling means comprises a first coupling means connected to a second coupling means by a shaft extension, said first and second coupling means and said shaft extension interconnecting said motor drive and mechanical shafting means, said electrical conductor extending axially through said second coupling and said shaft extension.

16. An apparatus as defined in claim 1 wherein said coupling means comprises a post and pivot coupling having interlocking fork members to transmit required torques.

17. An apparatus as defined in claim 1 wherein said coupling means is a flexible shaft section.

18. An apparatus as defined in claim 1 wherein said coupling means is a conventional universal joint.

19. An apparatus as defined in claim 1 wherein said rotary electrical connection means is an electrical swivel assembly having direct electrical contact between related rotating conducting parts.

20. An apparatus as defined in claim 1 wherein said rotary electrical connection means is a rotary transformer apparatus for the transmission of alternating current power and signal data by magnetic coupling means.

* * * * *